US006296508B1

(12) United States Patent
Kuwahara et al.

(10) Patent No.: US 6,296,508 B1
(45) Date of Patent: Oct. 2, 2001

(54) ELECTRICAL CONNECTOR HAVING POSITIONING DEVICE AND GUIDE

(75) Inventors: Masanori Kuwahara; Makoto Higashikozono, both of Yokkaichi (JP)

(73) Assignee: Sumitomo Wiring Systems, Ltd., Co., Yokkaichi (JP)

( * ) Notice: Subject to any disclaimer, the term of this patent is extended or adjusted under 35 U.S.C. 154(b) by 0 days.

(21) Appl. No.: 09/635,699

(22) Filed: Aug. 10, 2000

(30) Foreign Application Priority Data

Aug. 17, 1999 (JP) ..... 11-230466

(51) Int. Cl.[7] ..... H01R 13/627
(52) U.S. Cl. ..... 439/353
(58) Field of Search ..... 439/353, 357, 439/358, 680, 281, 282

(56) References Cited

U.S. PATENT DOCUMENTS

| | | | | |
|---|---|---|---|---|
| 2,877,437 | * | 3/1959 | Flanagan, Jr. | 439/353 |
| 4,211,461 | * | 7/1980 | Wescott | 439/357 |
| 4,973,266 | | 11/1990 | Bullard | 439/589 |
| 5,376,013 | | 12/1994 | Sawada | 439/271 |
| 5,536,103 | | 7/1996 | Sawada | 403/326 |
| 5,586,897 | | 12/1996 | Shinji et al. | 439/271 |
| 5,596,138 | | 1/1997 | Onodera et al. | 73/49.2 |
| 5,984,705 | | 11/1999 | Miyazaki et al. | 439/304 |
| 5,993,239 | * | 7/1998 | Wright | 439/357 |

FOREIGN PATENT DOCUMENTS 61279077 12/1986 (JP) .

* cited by examiner

*Primary Examiner*—Brian Sircus
*Assistant Examiner*—Javaid Nasri
(74) *Attorney, Agent, or Firm*—Greenblum & Bernstein P.L.

(57) ABSTRACT

An electrical connector is provided, the connector having male and female connector housings. When the male and female connector housings are fitted together, locking arms and detents provided thereon may be spaced in the circumferential direction. In such a case, the male and female connector housings are rotated relative to each other in order to find a matching position. The connector housings include a positioning groove and a positioning rib. When the housings are brought together, the locking arm and detent are fitted to each other. The male and female connector housings are thus fixed at a predetermined position in the circumferential direction. When the normal fixed state is attained, the locking arm and detent are locked together. As the locking arm and detent include the positioning groove and rib, it is no longer necessary to position the male and female connector housings through visual checking.

12 Claims, 7 Drawing Sheets

ELECTRICAL CONNECTOR HAVING POSITIONING DEVICE AND GUIDE

BACKGROUND OF THE INVENTION

1. Field of the Invention

The present invention relates to an electrical connector, and more particularly to its housing structure. The electrical connectors and their configuration according to the present invention may apply to the manufacture of a unipolar connector. Unipolar connectors are used in various types of electrical wiring. For instance, they may be used in an electric power generator which uses solar radiation, and in snow-melting tiles.

2. Description of Background Information

A unipolar connector is disclosed in a Japanese patent application published under No. SHO 61-279077. The disclosed unipolar connector comprises a pair of connector housings including metal terminals, and is engaged or released along its axial direction. It further comprises a locking means for holding a pair of connector housings together. The locking means comprises a locking arm formed on one outer rim of the connector housings, and a detent formed on the other outer rim thereof. When the pair of connector housings is being fitted, the locking arm interferes with the detent, and is elastically flexed along the radius of the connector housings. When the connector housings reach their normal fit position, the locking arm elastically returns, and is hooked by the detent. The pair of connector housings is thus locked into a non-releasable state. When the pair of connector housings is to be separated, the locking arm is flexed so as to be released from the detent.

When the connector is unipolar, the connector housings are formed in a cylindrical shape, so that they enclose the unipolar metal terminal extending along the central axis. The pair of connector housings must be rotatable relatively to each other around the central axis. The locking arm and the detent are formed at given positions in the circumferential direction. Accordingly, when the connector housings are to be fitted, the positions of the locking arm and detent must be adjusted in the circumferential direction.

The prior art connector housings envision no means for positioning the locking arm and the detent. The positioning is therefore effected by visually adjusting their mutual positions.

However, fitting work is sometimes performed under conditions where visual inspection is not possible. Connector fitting is then effected by touch. In such cases, working efficiency is greatly deteriorated.

The present invention has therefore a primary object to remedy such a situation, and to provide an electrical connector in which locking devices can be positioned without recourse to visual positioning.

SUMMARY OF THE INVENTION

The invention relates to an electrical connector including first and second connector housings respectively having a cylindrical shape with a concentric axis and having a circumferential direction. The first and second connector housings are engaged with each other by being brought together along a concentric axis.

The first and second connector housings include corresponding first and second metallic terminals connected to each other by mutually engaging the first and second connector housings.

The first connector housing include at least one locking arm which is elastic and flexible, while the second connector housing includes a corresponding number of locking dent(s) engageable with the locking arm(s), so that the first and second connector housings are mutually lockable.

The first and second connector housings further include positioning devices, the latter including at least one positioning groove formed in the first connector housing, and a corresponding number of positioning rib(s) formed in the second connector housing. The positioning groove(s) and rib(s) are arranged such that they can be fitted only when the locking arm(s) and detent(s) are positioned and fitted in the circumferential direction of the first and second connector housings, so that, when the positioning groove(s) and rib(s) are fitted, the first and second connector housings cannot rotate in the circumferential direction, but can only move along the concentric axis, relative to each other.

The first and second connector housings further include a guide enabling the first and second connector housings to rotate in the circumferential direction and move along the concentric axis, relative to each other when the positioning groove(s) and rib(s) are not fitted with each other.

The invention further concerns an electrical connector, in which the guide is formed in the first connector housing and includes a guiding portion into which the second connector housing is guided, and a fitting portion, and further includes a tapered guide step having a diameter reducing from the guiding portion towards the fitting portion. In this structure, the tapered guide step communicates with the positioning groove(s). The positioning rib(s) further has or have a tapered rib edge which rubs against the tapered guide step, when the tapered rib edge is biased from the positioning groove(s).

The invention further concerns the electrical connector, in which the locking arm(s) include a hook in the form of an overhang adapted for being hooked by the locking detent(s).

The invention further relates to a unipolar connector using the above-mentioned structure.

When both connector housings are being fitted, the positions of the locking arms and locking detents may be biased in the circumferential direction. In such a case, both connector housings may be pushed toward the fitting direction through the guiding mechanism, and rotated relative to each other. When the positions of the locking arms and detents are matched, the positioning grooves and ribs are fitted. As the fitting procedure progresses, both connector housings are fixed at a predetermined circumferential position. When the normal fitting state is attained, the locking arms and detents are locked. As the connector housings include a guide for matching the locking arms and detents, it is no longer needed to position them by visual matching.

When the positioning grooves and the positioning ribs are not matched, both connector housings are pushed toward the fitting direction along the concentric axis. Both connector housings are then automatically maintained in the concentric state. Accordingly, when the positioning grooves and ribs come to a matched position, they are engaged smoothly and securely.

While the hooking portion of the locking arms is locked with the locking detents along the direction of concentric axis, there may exist forces tending to separate the two connector housings. In such a case, the locking arms are subjected to flexing forces so as to be biased from the locking detents, due to the pressing actions between the hooking portion of the locking arms and the locking detents. However, as the hooking portion is overhung toward the locking detents, the flexure biasing the locking arms is obviated. The locked state is thus securely maintained.

BRIEF DESCRIPTION OF THE DRAWINGS

The above and the other objects, features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

Figure 1:
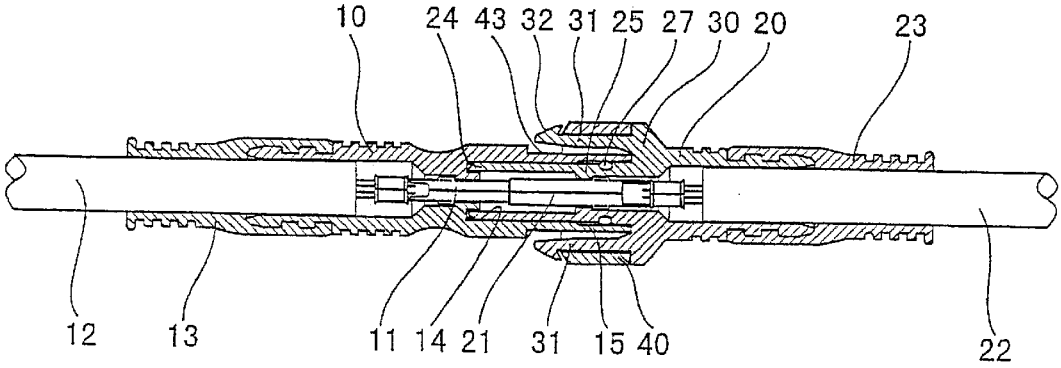
FIG. 1 is a sectional side view of the connector of the present invention, when the male and female connector housings are fitted.

The present connector includes a pair of connector housings 10 (male) and 20 (female) that are formed of any suitable insulating material. It also contains a pair of metal terminals 11 and 21. The male connector housing 10 is substantially in the form of a cylinder. It contains a cylindrical metallic male terminal 11, which is inserted from the left-hand side in FIGS. 1 and 2 towards the female connector housing 20 (right-hand side in FIGS. 1 and 2), and held on the same concentric axis. The rear end of the male terminal 11 is connected to an electrical cable 12 extending outwardly along the concentric axis. The rear circular end portion of the male connector housing 10 is fitted with a first seal member 13, e.g. a cylindrical element made of rubber, which hermetically seals the space around the electrical cable 12. The outer circular surface of the first cylindrical rubber seal member 13 and that of the male connector housing 10 are substantially continuously formed (without particular difference in surface level).

Figure 2:
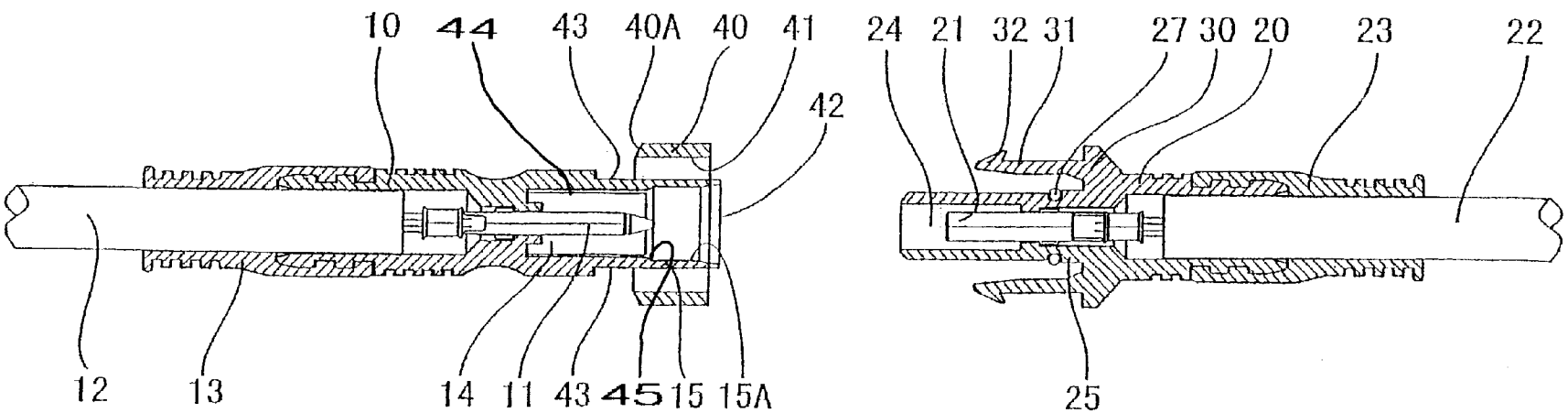
FIG. 2 is a sectional side view of the male and female connector housings of FIG. 1 when they are disengaged.

The front end portion of the male connector housing 10 forms a cylindrical hood-fitting portion 14 which surrounds the metallic male terminal 11 around the concentric axis while maintaining a circular space. The end portion of the hood-fitting portion 14 forms a guiding portion 15 (the guide of the present invention). The hood-fitting portion 14 and the guiding portion 15 are therefore formed concentrically with respect to the male connector housing 10. They have a uniform internal diameter, although that of the guiding portion 15 is slightly greater than that of the hood-fitting portion 14. Further, the hood-fitting portion 14 has an internal diameter adapted for closely engaging with a hood portion 24 of the female connector housing 20. The internal circular face of the guiding portion 15 forms a sealing face 15A on which a ring 27 of the female connector housing 20 is brought into a close contact (FIGS. 1 and 2).

The shape of the female connector housing 20 is substantially cylindrical, as is the shape of the male connector housing 10. It contains a cylindrical metallic female terminal 21 which is inserted into the male connector housing 10 from the right-hand side in FIGS. 1 and 2, and held around the concentric axis. The rear end of the metallic female terminal 21 is fixed to an electrical cable 22 which is led out from the rear end of the female connector housing along the concentric axis. The outer circular surface at the rear end of the female connector housing 20 is fitted with a second seal member 23, e.g. a cylindrical element made of rubber, which hermetically closes the space around the electrical cable 22. The outer circular surface of the second seal member 23 and that of the female connector housing 20 are substantially continuously formed (without particular difference in surface level).

The front end portion of the female connector housing 20 forms a hood portion 24 which encircles the metallic female terminal 21 around the concentric axis while maintaining a space. The hood portion 24 is thus formed in concentric relation with the female connector housing 20. The hood portion 24 has a constant outer diameter along the axial direction of the female connector housing 20. Moreover, it has an outer diameter adapted for closely fitting with the hood-fitting portion 14 of the male connector housing 10. Further, the rear side of the hood portion 24 forms a guide-seal member 25, e.g. made of rubber, having a diameter greater than that of the hood portion 24. The guide-seal member 25 has a seal groove 26 around its outer surface where the ring 27 is fitted.

Figure 10:
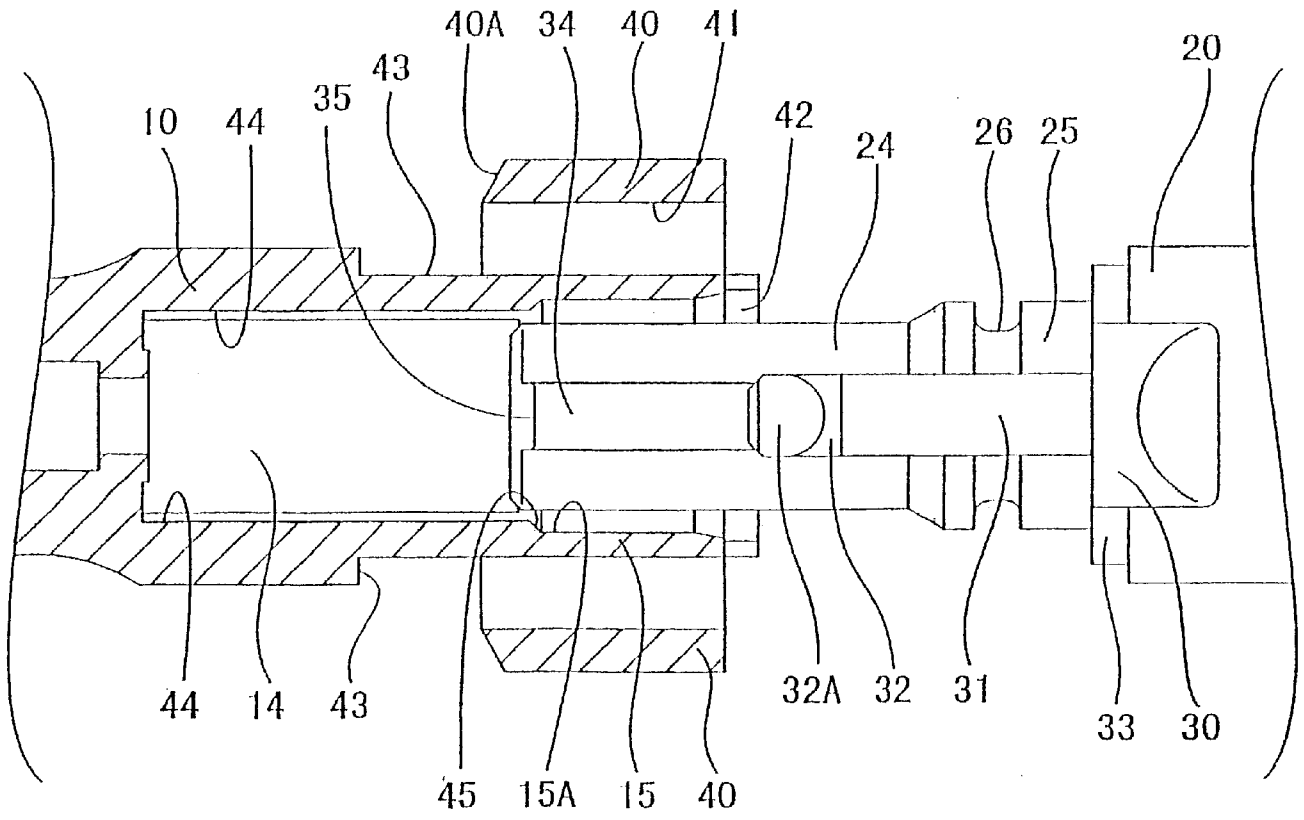
FIG. 10 is an enlarged sectional side view when the male and female connector housings are being fitted in a circumferentially spaced position.

The male and female connector housings 10 and 20 confront each other on the concentric axis, and are brought together for joining. The edge of the hood portion 24 then abuts against the cavity base of the hood-fitting portion 14, so that a normal fit state is attained. In this normal fit state, the hood portion 24 is inserted into the hood-fitting portion 14, so that the metallic male and female terminal 11 and 21 are connected. At the same time, the ring 27 closely engages with the sealing face 15A (FIG. 10) of the cylindrical guiding portion 15, so that the sealing of both the connector housings 10 and 20 is achieved and provides a hermetic condition.

Figure 7:
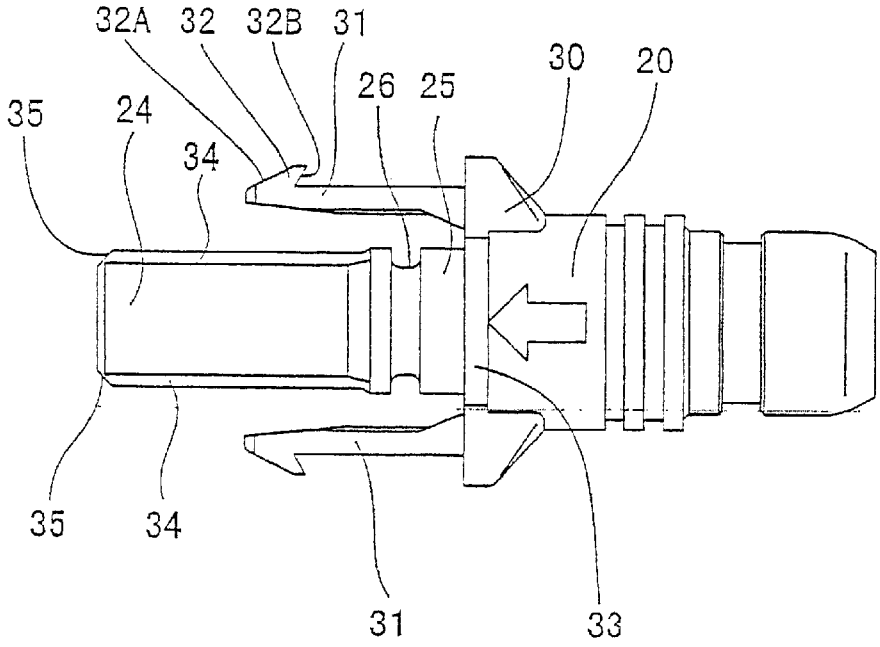
FIG. 7 is another side view of the female connector housing of FIG. 6.

In the present embodiment, the male and female connector housings 10 and 20 have locking devices that fix them in the normal fit condition. To this end, the female connector housing 20 includes a supporting protrusion 30 on its outer circular face at the rear end (on the right-hand side in FIGS. 1 and 7) of the guide seal member 25, while a pair of locking arms 31 projects forwardly (towards the left-hand side in the figures supra) in the form of an overhang from the supporting protrusion 30. The locking arms 31 are formed at distal positions in the circumferential direction, for example, at an angle of about 180°. Each locking arm 31 extends substantially in parallel relation over the axial direction of the female connector housing 20. The edge of the locking arm 31 reaches a middle point over the length of the hood portion 24 and is able to flex towards the radial direction (with respect to the concentric axis). The outer face (opposite the hood portion 24) of the edge of locking arm 31 is provided with a hook 32. The outer face of the hook 32 is tapered toward the radially inward direction, forming a hook front slant face 32A (FIG. 7). The rear side of the hook 32 is not formed perpendicularly to the concentric axis, but is inclined towards its front side along the concentric axis, so as to form a hook rear slant face 32B in the shape of an overhang (to be hooked by the locking detents 40). The hook rear slant face 32B forms a sharp angle with respect to the outer surface of the locking arms 31. This sharp angle is set at about 60° in the present embodiment, but it can have another sharp angle.

In the male connector housing 10, the outer circular face of the end zone of guiding portion 15 is provided with a pair of diametrically opposed locking detents 40. The locking detent 40 includes a path hole 41 which runs along the axial direction and forms a tunnel. The locking arm 31 passes through the path hole 41 in an elastically flexed state. The outer circular face of the rear end of the locking detent 40 forms a detent rear face 40A which faces the hook rear slant face 32B of the locking arm 31 in the axial direction, when both connector housing are fitted. The detent rear face 40A is inclined in the same direction as the hook rear slant face 32B. In the present embodiment, the detent rear face 40A has an angle of about 55°; however, it can also have another angle.

When male and female connector housing 10 and 20 are being fitted, the hook front slant face 32A of the hook 32 on the locking arm 31 abuts against the front end rim of the path hole 41 of the locking detent 40, so that the locking arm 31 is elastically flexed in a radially inward direction. The flexed locking arm 31 advances through the path hole 41, with the hook 32 rubbing against the path-hole inner face. When the locking arm 31 leaves the path hole 41 and is elastically restored, the hook rear slant face 32B faces up against the detent rear face 40A in the axial direction. The male and female connector housings 10 and 20 are thus unreleasably locked.

When a releasing force is applied to the engaged connector housings 10 and 20, the locking arm 31 is subjected to a radially outward displacement force (force opposed to the biasing force from the locking detent 40) by virtue of the inclination of the hook rear slant face 32B and detent rear face 40A. The male and female connector housings 10 and 20 can thus be reliably locked. When the outer edge of the hook rear slant face 32B (edge near the top edge of the hook 32) abuts against the detent rear face 40A, there is a risk of the hook 32 being deformed. However, as the inclination of the hook rear slant face 32B and the detent rear face 40A is designed such that the internal edge of the former (base portion of the hook 32) is brought into contact with the latter, the hook 32 receives no such deformation.

Figure 6:
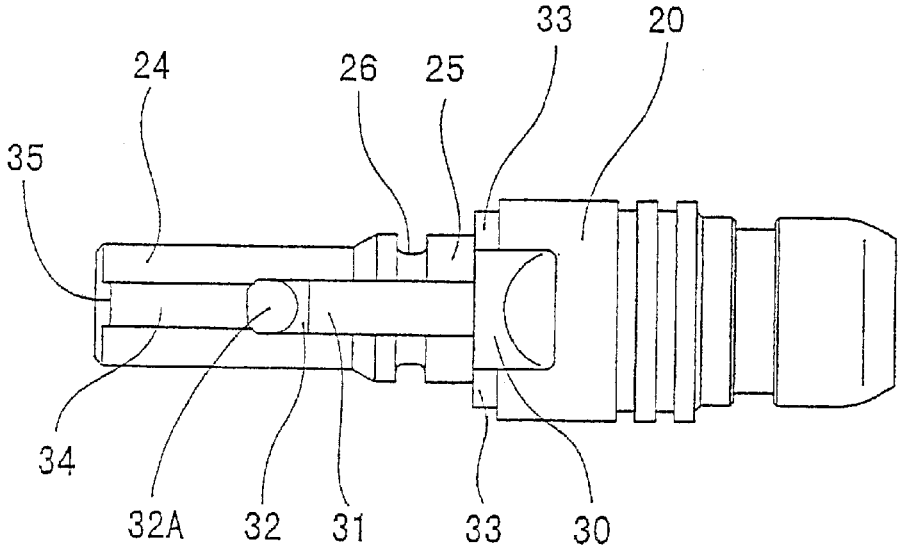
FIG. 6 is a side view of the female connector housing.

The diameter of the supporting protrusion 30 and that of the guide-seal member 25 in the female connector housing 20 are reduced stepwise at the outer circular front end of the zone where the supporting protrusion 30 is formed (FIGS. 6 to 8): an intermediate step 33 is formed at that point with a larger diameter than the guide-seal member 25. In the present embodiment, however, the intermediate step 33 is formed only in the part of zone where the supporting protrusion 30 is not formed. Alternatively, the supporting protrusion 30 may include a smaller-size intermediate step in such a case (not shown in the figures).

Figure 4:
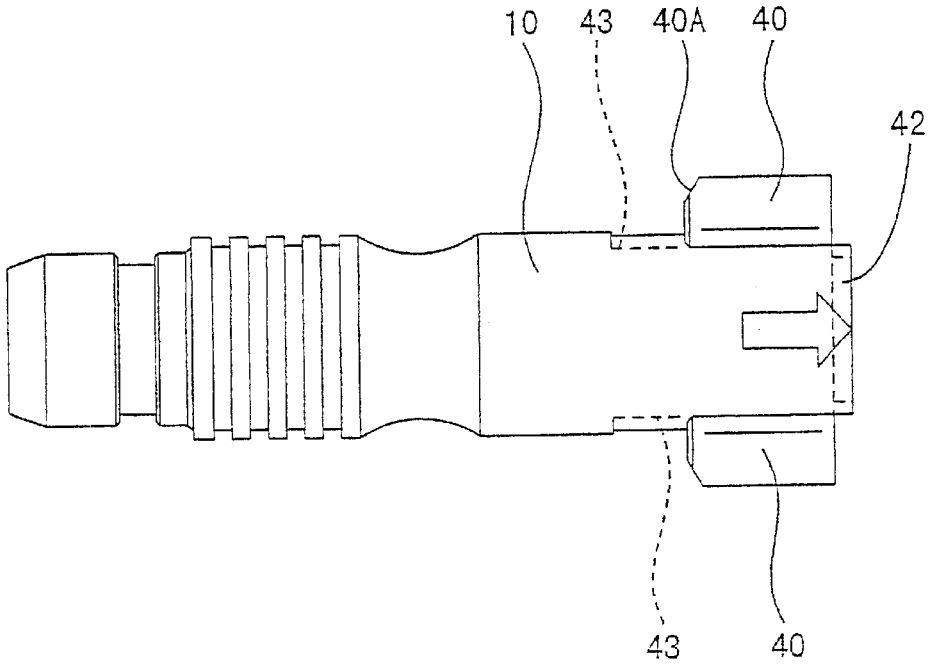
FIG. 4 is another side view of the male connector housing of FIG. 3 with hidden parts shown partially in phantom.
Figure 5:
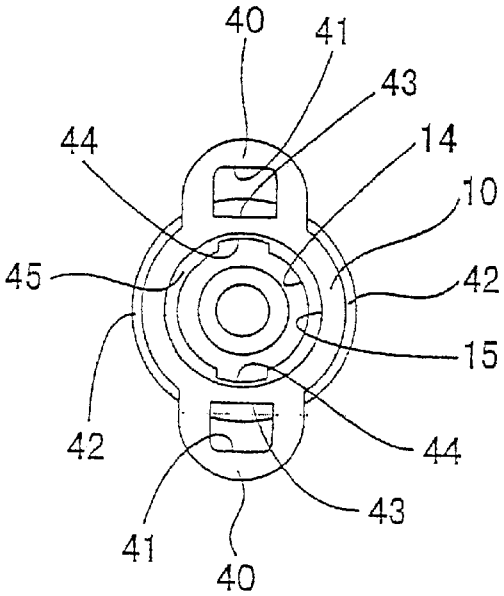
FIG. 5 is an end view of the male connector housing of FIG. 3.

In the male connector housing 10, a pair of arc-shaped overhangs 42 extends outwardly from the front end of the cylindrical guiding portion 15 (FIGS. 4 and 5). In a normally fitted state, the arc-shaped overhangs 42 fit over the intermediate steps 33. The outer surfaces of both the arc-shaped overhangs 42 and female connector housing 20 are fitted without forming steps or spaces. Likewise, in the normally fitted state, the outer surfaces of both the supporting protrusion 30 and locking detent 40 are fitted without forming steps or spaces. As a result, the fitting zone of the male and female connector housings 10 and 20 appears neat and aesthetically pleasing.

When the male and female connector housings 10 and 20 are fitted, the arc-shaped overhangs 42 fit over the intermediate steps 33, so that the circular fitting surface between the male and female connector housings 10 and 20 forms a labyrinth structure. Accordingly, even if water, dust or dirt is attached on their outer surface, there is no risk of it entering into the housings by passing through the fitting portion between the arc-shaped overhangs 42 and the intermediate steps 33. The fitting structure of the invention thus efficiently protects the housings from dust and water.

Figure 3:
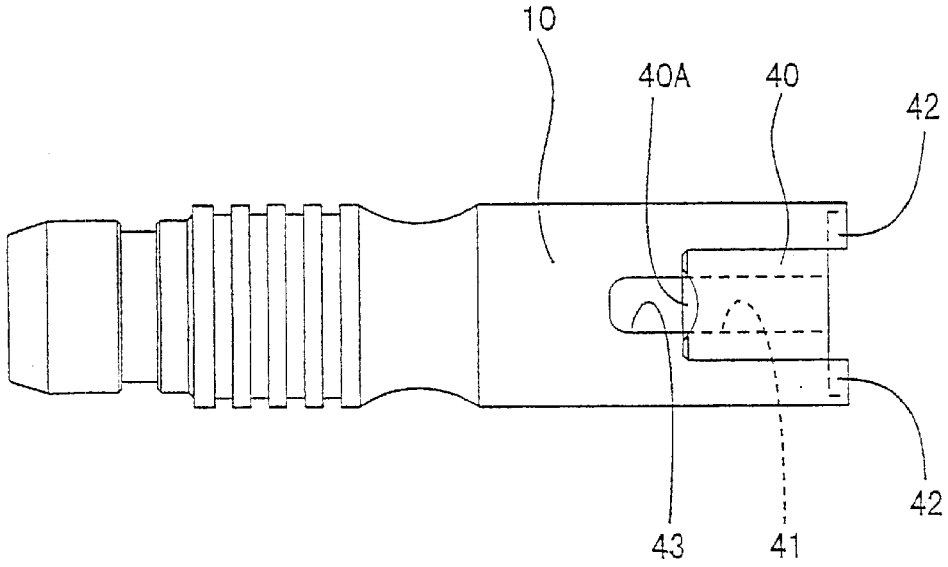
FIG. 3 is a side view of the male connector housing with hidden parts shown partially in phantom.

The distance between the inner surfaces of the pair of locking arms 31 is set to be smaller than the outer diameter of the guiding portion 15. The outer circular face of the guiding portion 15 is therefore provided with path recesses 43 which lead to the path holes 41 of the locking detents 40 (FIGS. 3 to 5). When the male and female connector housings 10 and 20 are being fitted, the locking arms 31 are elastically flexed in a radially inward direction. These flexed portions enter into the path recesses 43, which supply a space for passing the flexed locking arms 31. Since part of the space used for the flexed locking arms 31 is thus provided by forming an indentation on the outer circular face of the female connector housing 20, the locking arms 31 can be configured radially more inwardly than in the usual housings. The connector housings can thus be miniaturized as a whole.

When the male and female connector housings 10 and 20 are fitted, the positions of the locking arms 31 and locking detents 40 must be adjusted in the circumferential direction. In order to perform this position adjustment without having recourse to visual inspection, the present invention provides positioning device and a guide.

Figure 8:
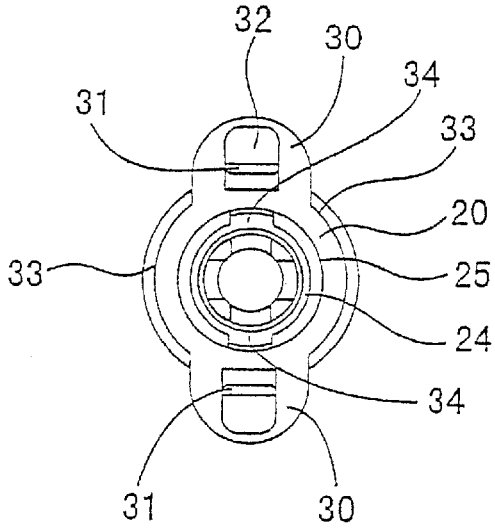
FIG. 8 is an end view of the female connector housing of FIG. 7.
Figure 9:
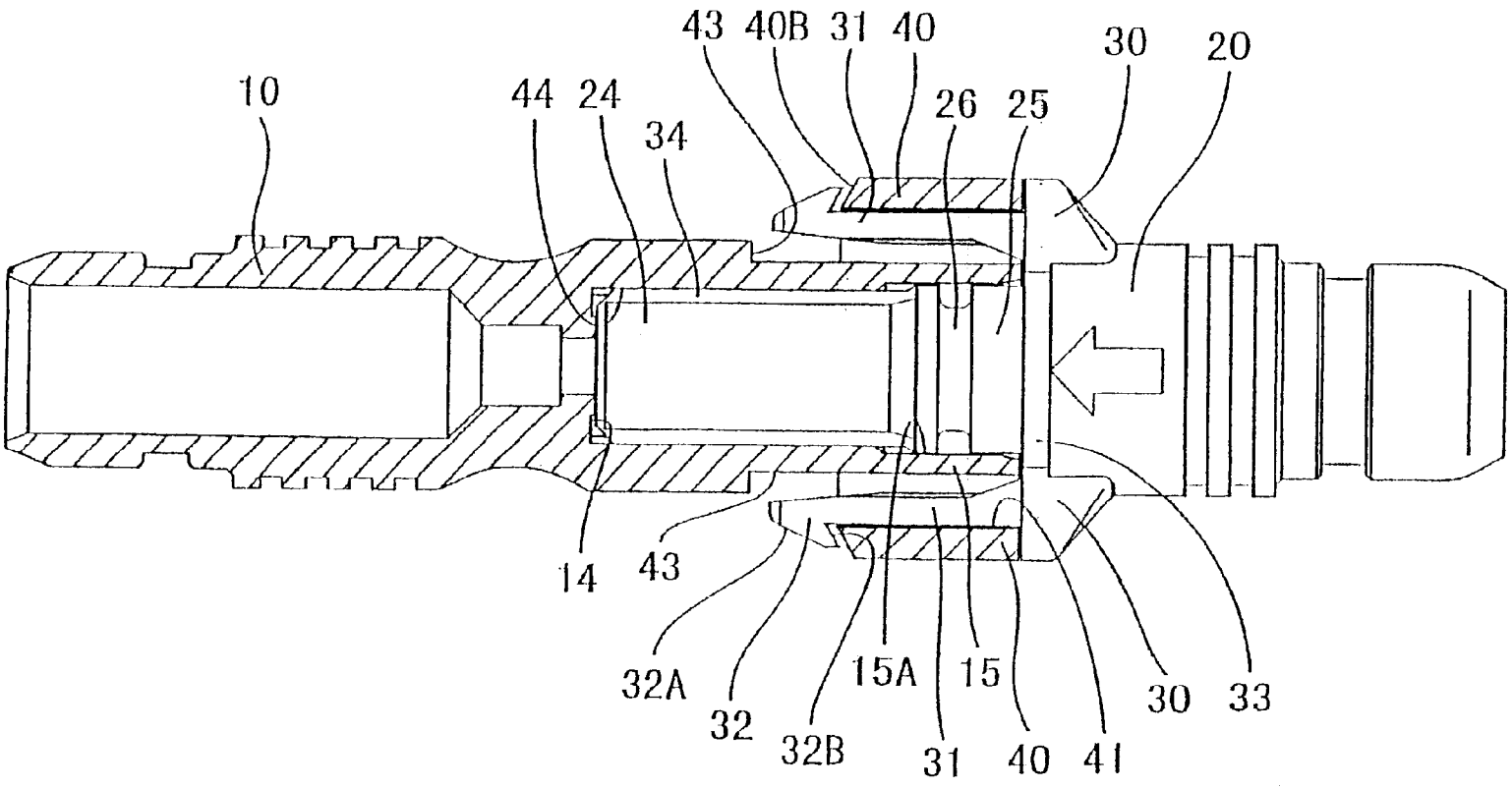
FIG. 9 is a sectional side view of the male and female connector housings when they are fitted.

The positioning device includes a pair of positioning grooves 44 provided on the male connector housing 10, and the corresponding pair of positioning ribs 34 provided on the female connector housing 20. The positioning grooves 44 are formed inside the fitting portion 14, and extend along the axial direction over the whole fitting portion 14. The two positioning grooves 44 are diametrically opposed, so as to correspond to the positions of the locking detents 40. The inner circular faces of the fitting portion 14 and guiding portion 15 are continuously formed through a tapered guide step 45, so that the diameter of the tapered guide step 45 decreases towards the male connector housing 10 (from right to left in FIG. 10). The positioning grooves 44 terminate so as to open in the tapered guide step 45. The positioning ribs 34 are formed on the outer circular surface of the hood portion 24 of the female connector housing 20, and extend over its entire length along the axial direction (FIGS. 7 and 8). The two positioning ribs 34 are diametrically opposed, so as to correspond to the positions of the locking arms 31. The edge face of the positioning ribs 34 forms a tapered rib edge 35 inclining radially inwardly along the axial direction of the female connector housing 20. The positioning grooves 44 and ribs 34 are designed so as to engage with each other only when the locking arms 31 and the locking detents 40 can be engaged in the circumferential direction. When the positioning grooves 44 and ribs 34 are fitted, the male and female connector housings 10 and 20 are blocked in relative rotational movement, but not limited from axial movement.

The guide includes a cylindrical guiding portion 15 formed on the male connector housing 10. Its inner diameter is slightly greater than the distance between the outer surfaces of the positioning ribs 34. Accordingly, when the hood portion 24 is inserted into the guiding portion 15, the male and female connector housings 10 and 20 can be rotated relative to each other around the concentric axis.

As a result, the invention gives the following effects. When the male and female connector housings 10 and 20 are being engaged, the hood portion 24 is inserted into the guiding portion 15. If the positions of the locking arms 31 and locking detents 40 are spaced in the circumferential direction, the tapered rib edge 35 of the positioning ribs 34 abuts against the tapered guide step 45 of the guiding portion 15. Further fitting movement of the male and female connector housings 10 and 20 is thus impeded. In such cases, the edge of the locking arms 31 do not interfere with the male connector housing 10. Subsequently, the male and female connector housings 10 and 20 are rotated relative to each other, by making use of a guiding function of the guiding portion 15. At this moment, both connector housings 10 and 20 are brought closer along the axial direction, so that the tapered guide step 45 and the tapered rib edge 35 rub against each other. By virtue of their tapered faces, the male and female connector housings 10 and 20 are held in a highly concentric state. As the male and female connector housings 10 and 20 are rotated, but before the rotation reaches 180°, the positioning grooves 44 and ribs 34 are fitted. The hood portion 24 then fits into the fitting portion 14, and the locking arms 31 are flexed and enter in the path holes 41. When the male and female connector housings 10 and 20 reach the normal fitting position, they are locked by the locking arms 31 and the locking detents 40. As the rotational movements of the housings are inhibited by the engagement of the positioning grooves 44 and ribs 34, and the hook attachment of the locking arms 31 with the detents 40 proceeds very smoothly.

As the male and female connector housings 10 and 20 include positioning grooves 44 and ribs 34, as well as a guiding portion 15 for positioning the locking arms 31 and detents 40, they can be positioned precisely, without recourse to visual adjustment. Operational efficiency is thus improved.

When only one locking arm and the corresponding detent are provided in the circumferential direction, the connector housings must be rotated by 360° at the most, before finding the matching position. From the point of view of working efficiency, it is therefore preferable to increase the number of locking arms 31 and detents 40. However, when the number exceeds three, the thickness of the connector as a whole becomes larger relative to the connector housings. Accordingly, when the priority is given to miniaturization, the number is preferably one or two. In the present embodiment, the locking arms 31 and detents 40 are formed on two positions at an interval of 180°. The maximum rotation angle is thus 180°. The thickness of the connector can thus be contained to about the same size as the outer diameter of the connector housings 10 and 20. The above configuration therefore satisfies the needs for facilitating handling and the miniaturization at the same time.

In the zone where the locking detents 40 are provided, the path recesses 43 are formed to serve as a space for passing the flexed locking arms 31. From the point of view of the mechanical strength, it is sufficient for the male connector housing 10 to have a diameter corresponding to the diametrical distance between the path recesses 43. However, if this diameter is applied to all parts of the male connector housing 10, the first seal member 13, when sealed, will give an extra thickness and thus a discontinuous step, thereby deteriorating the aesthetic appearance. In order to avoid the formation of this step, the entirety of the male connector housing 10 is designed so as to have an outer diameter similar to that of the first seal member 13. Accordingly, the path recesses 43 are indented only for the portion where a space is needed for passing the flexed locking arms 31. The path recesses 43 cover only a small space, and are hidden in the shadow of the locking detents 40. Moreover, when the male and female connector housings 10 and 20 are engaged, the locking arms 31 cover and hide the path recesses 43. Such a partially indented configuration for forming the path recesses 43 therefore does not create an aesthetic problem.

In the above embodiment, both of the positioning grooves 44 and ribs 34 extend along the axial direction. Alternatively, in a variant embodiment, only grooves 44 may run extensively in the axial direction, and the ribs 34 may be formed as protrusions that extend only a short distance in the axial direction (not shown).

Likewise, the positioning grooves 44 are formed on the inner circular face of the male connector housing 10, while the positioning ribs 34 are formed on the outer circular face of the female connector housing 20. Alternatively, the positioning grooves 44 may be formed on the outer circular face of the female connector housing 20, while the positioning ribs 34 may be formed on the inner circular face of the male connector housing 10.

Further, the positioning grooves 44 and ribs 34 are formed as two pairs at a distance of 180°. However, the number and circumferential positions thereof may be modified as desired.

Further yet, the positioning grooves 44 and ribs 34 are located at the positions corresponding to those of the locking detents 40 and the locking arms 31, respectively, in the circumferential direction. However, the positioning grooves 44 and ribs 34 may also be spaced from the positions of the locking detents 40 and arms 31.

In the above embodiments, the guiding portion 15 of the male connector housing 10 is used as a guide. Alternatively, the front edge of the positioning ribs 34 of the female connector housing 20 may be sharpened, and engaged with the fitting portion 14 of the male connector housing 10. Thereafter, the inner circular face of the fitting portion 14 may be used as a guide, so that both connector housings 10 and 20 can be guided along the concentric axis.

Likewise, the locking arms 31 are formed on the female connector housing 20, whilst the locking detents 40 are formed on the male connector housing 10. Instead, the locking arms 31 may be formed on the male connector housing 10, while the locking pawls 40 may be formed on the female connector housing 20.

Further yet, the locking arms 31 are formed on the female connector housing 20 only, while the locking pawls 40 are formed on the male connector housing 10 only. Instead, each of the male and female connector housings 10 and 20 may include both locking arms 31 and detents 40.

Further, the locking arms 31 and detents 40 are provided as two pairs at an angular distance of about 180°. Instead, the number and circumferential positions of the locking arms 31 and detents 40 may be changed as desired.

Although the invention has been described with reference to particular means, materials and embodiments, it is to be understood that the invention is not limited to the particulars disclosed and extends to all equivalents within the scope of the claims.

The present disclosure relates to subject matter contained in priority Japanese Application No. HE 11-230466, filed on Aug. 17, 1999, which is herein expressly incorporated by reference in its entirety.

What is claimed:

1. An electrical connector comprising first and second connector housings respectively having a cylindrical shape with a concentric axis and having a circumferential direction, said first and second connector housings being engageable with each other by being brought together along said concentric axis;

said first and second connector housings including a corresponding first and second metallic terminal connectable to each other by engaging said first and second connector housings with each other;

said first connector housing comprising at least one locking arm which is elastic and flexible, while said second connector housing comprises a corresponding number of locking detents engageable with said at least one locking arm, so that said first and second connector housings are lockable with each other;

said first and second connector housings further comprising a positioning device, said positioning device including at least one positioning groove formed in an inner peripheral surface of said first connector housing, and a corresponding number of positioning ribs formed on an outer peripheral surface of said second connector housing, said at least one positioning groove and rib being arranged such that they can be fitted together only when said at least one locking arm and detent are positioned and fitted in said circumferential direction of said first and second connector housings, so that, when said at least one positioning groove and rib are fitted, said first and second connector housings cannot rotate in said circumferential direction, but can move along said concentric axis, respectively relative to each other;

said first and second connector housings further comprising a guide enabling said first and second connector housings to rotate in said circumferential direction and move along said concentric axis, respectively relative to each other, when said at least one positioning groove and rib are not fitted with each other.

2. The electrical connector according to claim 1, wherein said guide is formed in said first connector housing and comprises a guiding portion into which said second connector housing is guided and a fitting portion, and further comprises a tapered guide step having a diameter reducing from said guiding portion towards said fitting portion, said tapered guide step communicating with said at least one positioning groove, and wherein said corresponding number of positioning ribs have a tapered rib edge which rubs against said tapered guide step, when said tapered rib edge is spaced from said at least one positioning groove.

3. The electrical connector according to claim 2, wherein said at least one locking arm comprises a hook in the form of an overhang configured to be hooked by said locking detents.

4. The electrical connector according to claim 1, wherein said at least one locking arm comprises a hook in the form of an overhang configured to be hooked by said locking detent.

5. A unipolar connector comprising first and second connector housings respectively having a cylindrical shape with a concentric axis and having a circumferential direction, said first and second connector housings being engageable with each other by being brought together along said concentric axis;

said first and second connector housings including corresponding first and second metallic terminals connectable to each other by engaging said first and second connector housings with each other;

said first connector housing comprising at least one locking arm which is elastic and flexible, and said second connector housing comprising a corresponding number of locking detents engageable with said at least one locking arm, so that said first and second connector housings are lockable with each other;

said first and second connector housings further comprising a positioning device, said positioning device including at least one positioning groove formed in an inner peripheral surface of said first connector housing, and a corresponding number of positioning ribs formed on an outer peripheral surface of said second connector housing, said at least one positioning groove and rib being configured such that they can be fitted together only when said at least one locking arm and detent are positioned and fitted in said circumferential direction of said first and second connector housings, so that, when said at least one positioning groove and rib are fitted together, said first and second connector housings cannot rotate in said circumferential direction, but can move along said concentric axis, respectively in relative relation to each other;

said first and second connector housings further comprising a guide enabling said first and second connector housings to rotate in said circumferential direction and move along said concentric axis, respectively relative to each other, when said at least one positioning groove and rib are not fitted with each other.

6. The unipolar connector according to claim 5, wherein said guide is formed in said first connector housing and comprises a guiding portion into which said second connector housing is guided, and a fitting portion, and further comprises a tapered guide step having a diameter reducing from said guiding portion towards said fitting portion, said tapered guide step communicating with said at least one positioning groove, and wherein said corresponding number of positioning ribs have a tapered rib edge which rubs against said tapered guide step, when said tapered rib edge is spaced from said at least one positioning groove.

7. The unipolar connector according to claim 5, wherein said at least one locking arm comprises a hook in the form of an overhang configured to be hooked by said locking detents.

8. The unipolar connector according to claim 6, wherein said at least one locking arm comprises a hook in the form of an overhang configured to be hooked by said locking detent.

9. An electrical connector comprising first and second connector housings respectively having a cylindrical shape with a concentric axis and having a circumferential direction, said first and second connector housings being engageable with each other by being brought together along said concentric axis;

said first and second connector housings including a corresponding first and second metallic terminal connectable to each other by engaging said first and second connector housings with each other;

said first connector housing comprising at least one locking arm which is elastic and flexible, while said second connector housing comprises a corresponding number of locking detents engageable with said at least one locking arm, so that said first and second connector housings are lockable with each other;

said first and second connector housings further comprising a positioning device, said positioning device including at least one positioning groove formed in said first connector housing, and a corresponding number of positioning ribs formed in said second connector housing, said at least one positioning groove and rib being arranged such that they can be fitted together only when said at least one locking arm and detent are positioned and fitted in said circumferential direction of said first and second connector housings, so that, when said at least one positioning groove and rib are fitted, said first and second connector housings cannot rotate in said circumferential direction, but can move along said concentric axis, respectively relative to each other;

said first connector housing further comprising a guide extending from the edge of said at least one positioning groove and being configured to accommodate said second connector housing with said at least one rib so that said first and second connector housings to rotate in said circumferential direction and move along said concentric axis, respectively relative to each other, when said second connector housing is accommodated in said guide and said at least one positioning groove and rib are not fitted with each other.

10. The electrical connector according to claim 9, wherein said guide further comprises a tapered guide step having a diameter reducing from said guide towards a fitting portion that includes the positioning groove, said tapered guide step communicating with said at least one positioning groove, and wherein said corresponding number of positioning ribs have a tapered rib edge which rubs against said tapered guide step, when said tapered rib edge is spaced from said at least one positioning groove.

11. The electrical connector according to claim 9, wherein said at least one locking arm comprises a hook in the form of an overhang configured to be hooked by said locking detent.

12. The electrical connector according to claim 11, wherein said at least one locking arm comprises a hook in the form of an overhang configured to be hooked by said locking detents.

* * * * *

UNITED STATES PATENT AND TRADEMARK OFFICE

CERTIFICATE OF CORRECTION

PATENT NO. : 6,296,508 B1
DATED : October 2, 2001
INVENTOR(S) : Masanori Kuwahara et al.

It is certified that error appears in the above-identified patent and that said Letters Patent is hereby corrected as shown below:

Title page,
Item [73], Assignee: "Sumitomo Wiring Systems, Ltd., Co., Yokkaichi (JP)"
should be -- Sumitomo Wiring Systems, Ltd., Yokkaichi (JP) --

Signed and Sealed this

Seventeenth Day of December, 2002

JAMES E. ROGAN
*Director of the United States Patent and Trademark Office*